US005489783A

United States Patent [19]

Kristiansson

[11] Patent Number: 5,489,783

[45] Date of Patent: Feb. 6, 1996

[54] ELECTRON ACCELERATOR FOR STERILIZING PACKAGING MATERIAL IN AN ASPETIC PACKAGING MACHINE

[75] Inventor: Anders Kristiansson, Lund, Sweden

[73] Assignee: Tetra Laval Holdings & Finance S.A., Pully, Switzerland

[21] Appl. No.: 229,307

[22] Filed: Apr. 18, 1994

[30] Foreign Application Priority Data

Apr. 28, 1993 [SE] Sweden ..... 93014280

[51] Int. Cl.[6] ..... H01J 33/04

[52] U.S. Cl. ..... 250/442.3; 313/420; 53/551

[58] Field of Search ..... 250/492.3, 492.1; 313/420; 315/118.81; 219/121.21; 53/550, 551

[56] References Cited

U.S. PATENT DOCUMENTS

| | | | |
|---|---|---|---|
| 3,778,655 | 12/1973 | Luce | 313/63 |
| 3,779,706 | 12/1973 | Nablo . | |
| 3,780,308 | 12/1973 | Nablo . | |
| 3,854,874 | 12/1974 | Loliger | 21/91 |
| 3,911,642 | 10/1975 | Ernstsson et al. | 53/28 |
| 4,014,158 | 3/1977 | Rausing . | |
| 4,305,000 | 12/1981 | Cheever . | |
| 4,367,412 | 1/1983 | Cheever . | |
| 5,210,426 | 5/1993 | Itoh et al. | 250/492.3 |
| 5,262,633 | 11/1993 | Kasai et al. | 250/208.1 |

*Primary Examiner*—Jack I. Berman
*Attorney, Agent, or Firm*—Burns, Doane, Swecker & Mathis

[57] ABSTRACT

The present invention relates to an electron accelerator which is employed for sterilizing packaging material and which is included as part of an aseptic packaging machine which is intitially sterilized by means of an oxidizing chemical sterilizing agent such as $H_2O_2$ and steam. A "window" of an electron accelerator, which is covered by metallic window foil, includes a thin coating of glass disposed on the window foil. The glass coating protects the window foil against chemical action such as oxidation resulting from the chemical sterilizing agent $H_2O_2$.

16 Claims, 1 Drawing Sheet

ELECTRON ACCELERATOR FOR STERILIZING PACKAGING MATERIAL IN AN ASPETIC PACKAGING MACHINE

FIELD OF THE INVENTION

The present invention relates to an electron accelerator having a vacuum chamber including a cathode and an outlet aperture, including a metal foil through which the accelerated electrons depart from the accelerator.

BACKGROUND ART

It has long been known in the art to sterilize, for example, packages and packaging material webs with the aid of accelerated, energy-enriched electrons with which the webs or the packages are bombarded. The electron beam requisite for the sterilization is generated by means of a so-called electron accelerator which basically consists of a closed vacuum chamber which houses a cathode. From the cathode, electrons can be emitted in different ways and these are accelerated towards an anode which has high electric potential difference as compared with the cathode. The generated electrons accelerated toward the anode depart from the electron accelerator through a so-called window which in general includes a thin metal foil and is aimed at the object intended for sterilization. Such a sterilization with the aid of energy-enriched electrons has proved to be highly efficient for neutralizing micro-organisms. Many drawbacks which are associated with chemical sterilization and thermal sterilization are avoided through electron sterilization. Particularly, damage to materials which are not resistant to the chemical agents and/or to heat is avoided through electron sterilization.

One drawback in the electron accelerators which are employed today is that the window foil often breaks, since it is subjected to extreme stresses, and replacement of window foil is generally a complicated and time-consuming operation, which involves considerable operational disruption and costs. The window foil is generally an extremely thin aluminium foil, or titanium foil and the stresses to which it is exposed are, on the one hand, the mechanical stress which has its basis in the pressure difference between the vacuum chamber and the ambient environment surrounding the vacuum chamber, and, on the other hand, the fact that the electron beam through the foil entails a heating of the foil. Since the thin window foil makes up a part of the wall of the vacuum chamber, it must mostly be supported by some form of grid or mesh in order that the mechanical stresses arising out of the pressure difference do not become too great, and this grid or mesh may also be designed so that it leads off generated heat. When such electron accelerators are employed in connection with automatic packaging machines, they are most often disposed within a sterile chamber in which a sterile atmosphere must prevail in order to prevent the web which is sterilized by electron radiation from being reinfected after the sterilization operation. In order to achieve this sterile environment, the machine (and in particular the aseptic chamber) is initially sterilized with the aid of chemical sterilization agents, normally $H_2O_2$, and steam. The atmosphere of a chemical sterilization agent such as $H_2O_2$ is powerfully oxidizing, which entails that the window foil of the electron accelerator is chemically modified and weakened, especially when the chemical action is reinforced by heating by steam. The condensate which is formed when the steam changes aggregation state has also proved to have negative effects on the window foil and creates corroded areas in particular along the edge regions of the window foil. A further factor which acts negatively on the service life of the window foil is the ozone which is formed by the prevailing electric fields of high field force. Initial sterilization of the packaging machine must be carried out on each start-up after lengthy down time and the active life of the chemical sterilization agent or the steam is relatively lengthy (10 minutes to a few hours). Because of the chemical action on the outside of the window foil, the window foil is weakened in such a manner that the prevailing pressure difference on either side of the window foil in combination with the heating which takes place in the operative state of the electron accelerator and the action of the ozone created during operation often results in the window foil rupturing, whereupon the vacuum in the vacuum chamber of the electron accelerator is cancelled and the electron accelerator ceases to function. The window foil must, in such an event, be replaced, which, as was mentioned above, is an operation requiring considerable work and considerable time.

SUMMARY OF THE INVENTION

In order to obviate the above-outlined drawbacks, the window foil has been modified according to the present invention which is characterized in that the window foil of metal displays, on at least that side which forms the outside of the window foil, a thin coating of a tight material which is resistant to chemical attack, preferably glass.

BRIEF DESCRIPTION OF THE DRAWINGS

The present invention will now be described in greater detail hereinbelow, with particular reference to the accompanying Drawings. In the accompanying drawings.

DETAILED DESCRIPTION

Figure 1:
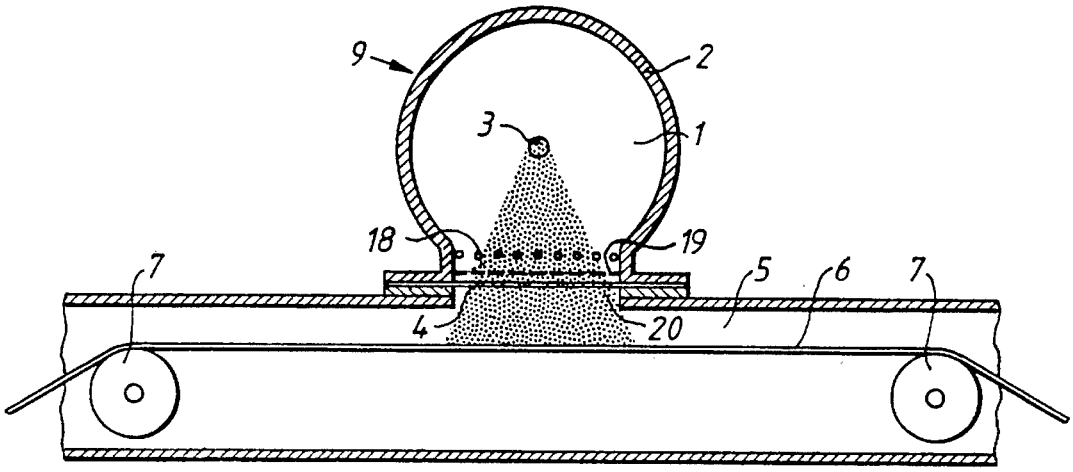
FIG. 1 is a schematic cross-sectional view of an electron accelerator according to an embodiment of the present invention.
Figure 3:
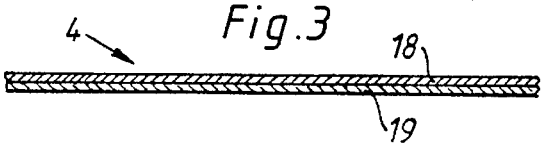
FIG. 3 is a schematic cross-sectional view according to an embodiment of the present invention of a window foil.

The electron accelerator 9 illustrated in FIG. 1 includes a casing 2 which surrounds a vacuum chamber 1. In the casing 2, there is an aperture 20 which is in communication with a space 5 in which is advanced a continuous packaging material web 6 which is passed over bending rollers 7. The aperture 20, referred to herein as a "window", is covered by a window foil 4 of metal, preferably titanium foil or aluminium foil. A cathode 3, an anode 19 and guide grids 18 are disposed in the vacuum chamber 1. The purpose of the cathode is to emit electrons (the electron beam is indicated by reference numeral 21), the electrons being accelerated toward the anode 19 in order thereafter to depart from the vacuum chamber 1 through the window foil 4 and surface sterilize the web 6 advanced under the window 20. The electrons may be emitted in many different ways. For example, it is possible to provide warm cathodes when electrons are emitted thermally. It is also possible to generate electrons with the aid of field emission in which the electrons are generated with the aid of a powerful electric field and it is also possible to generate electrons by so-called secondary emission, i.e., electrons from an electron source are caused to bombard a cathode which in its turn emits secondary electrons which are accelerated and employed for the sterilization operation. It is of no major consequence in the present case how the electrons are emitted from the cathode 3, but common to all electron accelerators 9 is that the emitted electrons from the cathode are caused to move at accelerated velocity towards an anode 19 which has high electric potential difference compared with the cathode 3. The anode 19 may include a grid or mesh and the appearance and velocity of the electron beam 21 can, to some extent, be controlled with the aid of guide grids 18 whose potential is lower than the potential of the anode 19. A window foil 4 is disposed as a wall in the vacuum chamber 1, the window foil covering the window aperture 20. In the present case, the window foil 4 therefore, in the manner illustrated in FIG. 3, a thin metal foil 22 of titanium or aluminium, whose outside 23 includes a coating of a material which is inert to chemicals, for example, glass or a glass-like material which may be designated $SiO_x$, where x is less than 2.

When electrons are generated in any of the above described manners by the cathode 3, these electrons (which are readily movable within the vacuum chamber 1 because of the low pressure) will move rapidly under acceleration towards the anode 19 which has a considerable potential difference compared with the cathode 3. The size of the potential difference is decisive for the kinetic energy of the electrons and the larger the kinetic energy the electrons have when they depart from the accelerator 9, the greater the efficiency and penetration depth they will have when they impinge upon the material web 6 intended for sterilization. The potential difference between the cathode 3 and the anode 19 may, for example, be between 10 and 100 kV.

Figure 2:
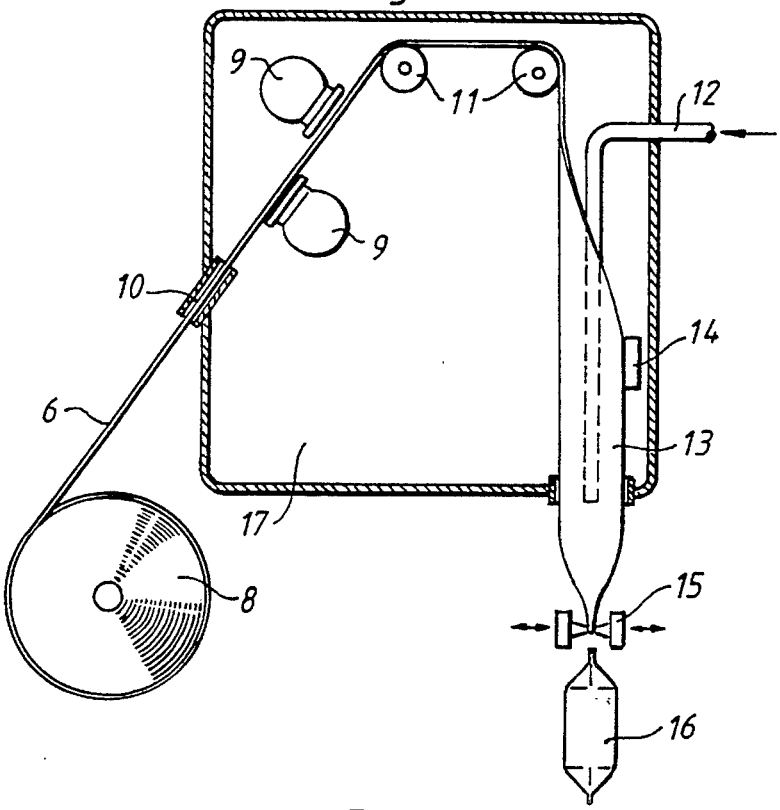
FIG. 2 is a schematic cross-sectional view of a packaging machine for aseptic packing of sterile according to an embodiment of the present invention.

When electron accelerators 9 are employed for sterilizing packaging material in automatic packaging machines, they can, for instance, be arranged in the manner illustrated in FIG. 2 which illustrates a sterile chamber 17 into which a packaging material web, which is unwound from a magazine reel 8, is fed through a passage 10. In the sterile chamber 17, a sterile atmosphere is maintained and, in order that no infected air can penetrate in through the passage 10, a slight excess pressure is maintained within the sterile chamber 17. The web 6 introduced into the sterile chamber 17 is caused to pass, in this case, two accelerators 9 whose window apertures 20 are aimed towards the surface of the packaging material web 6. On passage of the packaging material web 6 past the accelerators 9, the surface of the web 6 is affected by electron beams of energy-enriched electrons from the accelerators 9, whereupon both sides of the web are sterilized. The web is thereafter led over a bending roller 11, formed into a tube in that the longitudinal edges of the web 6 are united to one another and sealed by means of a longitudinal sealing device 14. The tube 13 of sterilized packaging material is filled with sterile contents through the supply conduit 12, whereafter the tube is discharged out of the sterile chamber 17 and is divided by means of sealing devices 15 into individual packaging units 16 by repeated transverse seals transverse to the longitudinal direction of the tube 13. The thus formed packaging units 16 can then be separated into individual packaging containers by means of incisions in the sealing zones, and may be formed by folding or other means into parallelepipedic packages or packages of other configuration.

Before packaging production is commenced, all parts of the sterile chamber 17 must be pre-sterilized or initially sterilized. Such a pre-sterilization proceeds such that a sterilizing chemical, for example $H_2O_2$, is fed into the sterile chamber 17 by spraying or in vaporized form. Preferably, superheated steam is also fed in, which substantially raises the sterilization effect of the hydrogen peroxide. Steam alone can also be used as a pre-sterilization agent. After the action of the hydrogen peroxide and/or steam during a period of time corresponding to between ten minutes and a few hours, the sterile chamber 17 and all parts which are in the sterile chamber are sterilized, whereupon production can be commenced. Such an initial sterilization of the packaging machine and the sterile chamber 17 entails that all parts within the sterile chamber 17 are subjected to chemical action or the action of steam condensate. Since hydrogen peroxide is powerfully oxidizing, the window foil 4 will, if its metallic portion is directly exposed to the hydrogen peroxide, be affected in such a manner that it is weakened, which entails that, in the manner described above, the window foil can rupture because of the mechanical stresses which occur as a result of the pressure difference between the vacuum chamber 1 and the atmosphere outside the vacuum chamber 1. In the case illustrated here, the window foil 4 consists, however, of a metal foil 22, for example aluminium foil or titanium foil which is coated with a thin layer of a glass material 23. Since this glass layer is inert to hydrogen peroxide and steam condensate, the metal foil 22 will not be damaged and a considerably increased service life of the window foil 4 can be achieved, which entails major economic and practical advantages.

The layer 23 of glass material can be applied to the metal foil 22 by so-called vacuum deposition. There are known methods which fundamentally take as their point of departure the introduction of a foil, for example a metal foil 22, into a chamber at low pressure and the introduction into the same chamber of a silicon compound in liquid form which is gasified so as to form a vapour. If, in this atmosphere, the gas is ionized with the aid of electrodes, the vaporized silicon compound will, in a thus formed plasma, be chemically converted into a glass material of the general formula $SiO_x$, where x is less than 2. This glass material will obtain good adhesion to the metal foil 22 and the glass material itself which is deposited on the metal foil forms a tight and chemically resistant coating. The thus formed glass film 23 can be made extremely thin, which is of importance since, in the practical field of application disclosed herein, the glass film 23 in itself constitutes a retardant to the electron beam 21. However, it has also proved that extremely thin glass layers 23 which are only a few molecules thick possess good resistance to chemical action of $H_2O_2$ and a slight retardant effect on the electron beam 21. The glass layer 23 also contributes in mechanically reinforcing the metal foil 22 to some extent and thereby making the window film 4 mechanically more durable.

It has proved possible, at relatively low cost, to achieve major advantages by employing a glass coated window foil 4 in accordance with the present invention, in particular in connection with packaging machines which are initially sterilized using chemical sterilization agents. Window foil 4 with a glass coating can, however, also advantageously be employed in connection with electron accelerators which are intended for other purposes where chemical or other action on the window foil is imminent, and it should be observed that ozone is always formed in the use of electron accelerators of the type disclosed here, the ozone having an oxidizing and thereby weakening effect on the metal in the window foil, for which reason the employment of a glass coated window foil 4 also affords advantages in electron accelerators which are not employed in an atmosphere in which the window foil is exposed to chemical action deriving from added chemicals such as hydrogen peroxide.

The present invention should not be considered as restricted to the particular embodiments described above and shown on the drawings, many modifications being conceivable without departing from the spirit and scope of the appended Claims.

What is claimed is:

1. An electron accelerator comprising:

a vacuum chamber including a cathode, the vacuum chamber having a window through which electrons accelerated from the cathode depart from the electron accelerator, the window including a metal foil and a coating of a chemically resistant material on an outer side of the metal foil, wherein the chemically resistant material includes a material of the general chemical formula $SiO_x$, where X is less than 2.

2. The electron accelerator as claimed in claim 1, wherein the coating is a vacuum deposited coating.

3. The electron accelerator as claimed in claim 1, wherein the metallic foil includes aluminum foil.

4. The electron accelerator as claimed in claim 1, wherein the metallic foil includes titanium foil.

5. A window for a vacuum chamber of an electron accelerator, the window comprising:

a metal foil; and a coating of a chemically resistant material on the outside of the window foil, wherein the chemically resistant material includes glass.

6. A window according to claim 5, wherein the coating structurally reinforces the metal foil.

7. A window according to claim 5, wherein the coating protects against chemical degradation of the metal foil.

8. A window according to claim 5, wherein the chemically resistant material includes a material having the general chemical formula $SiO_x$, where X is less than 2.

9. A window according to claim 5, wherein the coating is a vacuum deposited coating.

10. A window according to claim 5, wherein the metal foil includes aluminum.

11. A window according to claim 5, wherein the metal foil includes titanium.

12. A window according to claim 5, wherein the coating is sufficiently thin to avoid substantial retardation of an electron beam.

13. A packaging machine for aseptic packaging of sterile contents, comprising;

a sterile chamber having an inlet opening;

means for advancing a packaging material web through an interior of the sterile chamber in a predetermined path;

means, disposed inside the sterile chamber, for forming the web into a tube;

means, disposed inside the sterile chamber, for filling the tube with sterile contents;

means, disposed inside the sterile chamber, for sterilizing the web, the sterilizing means including an electron accelerator position adjacent the path of the web, the electron accelerator including a vacuum chamber and a cathode disposed inside of the vacuum chamber, the vacuum chamber having a window through which electrons accelerated from the cathode depart from the electron accelerator, the window including a metal foil and a coating of a chemically resistant material on an outer side of the metal foil, wherein the chemically resistant material includes glass.

14. The packaging machine as set forth in claim 13, wherein the sterilizing means includes two electron accelerators disposed on opposite sides of a path of travel of the web to sterilize opposite sides of the web.

15. The packaging machine as set forth in claim 13, further comprising means for forming the tube filled with sterile contents into individual packaging units.

16. An apparatus for treating a packaging material web, comprising:

means for advancing a packaging material web; and means for treating the web, the treating means including an electron accelerator, the electron accelerator including a vacuum chamber and a cathode disposed inside of the vacuum chamber, the vacuum chamber having a window through which electrons accelerated from the cathode depart from the electron accelerator, the window including a metal foil and a coating of a chemically resistant material on an outer side of the metal foil, wherein the chemically resistant material includes glass.

* * * * *